US011280527B2

(12) United States Patent
Wang et al.

(10) Patent No.: US 11,280,527 B2
(45) Date of Patent: Mar. 22, 2022

(54) MULTI-SPLIT SYSTEM AND METHOD AND APPARATUS FOR ADJUSTING OIL VOLUME OF COMPRESSOR OF MULTI-SPLIT SYSTEM

(71) Applicants: GD MIDEA HEATING & VENTILATING EQUIPMENT CO., LTD., Foshan (CN); MIDEA GROUP CO., LTD., Foshan (CN)

(72) Inventors: Mingren Wang, Foshan (CN); Kun Yang, Foshan (CN)

( * ) Notice: Subject to any disclaimer, the term of this patent is extended or adjusted under 35 U.S.C. 154(b) by 173 days.

(21) Appl. No.: 16/626,883

(22) PCT Filed: Nov. 8, 2018

(86) PCT No.: PCT/CN2018/114617

§ 371 (c)(1),
(2) Date: Dec. 27, 2019

(87) PCT Pub. No.: WO2019/091431

PCT Pub. Date: May 16, 2019

(65) Prior Publication Data

US 2020/0141619 A1 May 7, 2020

(30) Foreign Application Priority Data

Nov. 10, 2017 (CN) ..... 201711107017.7

(51) Int. Cl.
*F25B 31/00* (2006.01)
*F25B 49/02* (2006.01)
*F25B 41/20* (2021.01)

(52) U.S. Cl.
CPC ..... *F25B 31/004* (2013.01); *F25B 41/20* (2021.01); *F25B 49/02* (2013.01); *F25B 2500/16* (2013.01);

(Continued)

(58) Field of Classification Search
CPC ..... F25B 2500/16; F25B 2600/2519; F25B 2700/03; F25B 31/004; F25B 49/02
See application file for complete search history.

(56) References Cited

U.S. PATENT DOCUMENTS

2014/0331712 A1* 11/2014 Kan ..... F25B 43/02 62/470
2015/0219372 A1* 8/2015 Jeong ..... F25B 6/02 62/323.1

(Continued)

FOREIGN PATENT DOCUMENTS

CN 1786606 A 6/2006
CN 102305439 A 1/2012

(Continued)

OTHER PUBLICATIONS

International Search Report dated Jan. 11, 2019 in the corresponding International Application No. PCT/CN2018/114617.

(Continued)

*Primary Examiner* — Henry T Crenshaw
(74) *Attorney, Agent, or Firm* — Kilpatrick Townsend & Stockton, LLP

(57) ABSTRACT

A method and device for adjusting an oil volume of a compressor of a multi-split system. The method comprises the following steps: (S1) during an operation of a multi-split system, detecting at a first pre-set time interval whether an oil volume of a compressor is insufficient; (S2) if the oil volume of the compressor is insufficient, controlling an oil volume adjusting unit to turn on for a second pre-set time and then turn off; (S3) acquiring a total turn-on time of the oil volume adjusting unit, and determining whether the total turn-on time exceeds a pre-set value; (S4) if the total turn-on time exceeds the pre-set value and it has not been detected over a continuous third pre-set time that the oil volume of (Continued)

the compressor is insufficient, recycling oil back to an oil storage tank by controlling a switch unit and the oil volume adjusting unit.

4 Claims, 4 Drawing Sheets

(52) U.S. Cl.
CPC ... *F25B 2500/18* (2013.01); *F25B 2600/2519* (2013.01); *F25B 2700/03* (2013.01)

(56) References Cited

U.S. PATENT DOCUMENTS

| | | | | |
|---|---|---|---|---|
| 2020/0200403 | A1* | 6/2020 | Wang | F04B 39/0207 |
| 2020/0224944 | A1* | 7/2020 | Cole | F04B 39/0207 |

FOREIGN PATENT DOCUMENTS

| | | | |
|---|---|---|---|
| CN | 102305439 | * | 1/2014 |
| CN | 103486785 | A | 1/2014 |
| CN | 203454497 | U | 2/2014 |
| CN | 103925740 | A | 7/2014 |
| CN | 107218741 | A | 9/2017 |
| JP | 2008139001 | A | 6/2008 |
| JP | 4110818 | B2 | 7/2008 |

OTHER PUBLICATIONS

OA dated Apr. 19, 2019 for CN application 201711107017.7.
English translation of OA dated Apr. 19, 2019 for CN application 201711107017.7.
OA dated Jan. 8, 2020 for CN application 201711107017.7.
English translation of OA dated Jan. 8, 2020 for CN application 201711107017.7.

* cited by examiner

MULTI-SPLIT SYSTEM AND METHOD AND APPARATUS FOR ADJUSTING OIL VOLUME OF COMPRESSOR OF MULTI-SPLIT SYSTEM

CROSS-REFERENCE TO RELATED APPLICATION

This application is a national stage of International Application No. PCT/CN2018/114617, filed on Nov. 8, 2018, which claims priority to and benefits of Chinese Patent Application Serial No. 201711107017.7, filed with the National Intellectual Property Office Administration of P. R. China on Nov. 10, 2017, the entire content of which is incorporated herein by reference.

FIELD

The present disclosure relates to a field of air conditioners, and more particularly to a method for adjusting an oil volume of a compressor of a multi-split system, an apparatus for adjusting an oil volume of a compressor of a multi-split system and a multi-split system including such an apparatus.

BACKGROUND

A compressor of a multi-split system requires sufficient lubricating oil for lubrication. If the oil amount of the compressor is insufficient, the lubrication is insufficient and a problem of power increase of the compressor and abrasion of moving components of the compressor may cause the compressor to burn. During installation, when the multi-split system requires a longer piping or a larger indoor unit ratio, the lubricating oil in the piping and the indoor units of such a multi-split system may be increased compared to a short-piping multi-split system. In order to ensure that there is sufficient lubricating oil in the compressor, the system needs to be filled with more refrigeration oil. If additional lubricating oil is added during installation of the multi-split system, problems caused by such as water ingress, mixed lubricating oil and improper charging amount may occur. On this basis, it is required to add a maximum amount of lubricating oil according to an installation range design of a product during the product design. However, in this case, when the installation of the system only requires a short piping, redundant lubricating oil will enter a heat exchanger and a refrigerant connection pipe of the system, resulting in a decrease in heat exchange performance of the heat exchanger and an increase in pressure loss of the refrigerant connection pipe, which seriously affects operating efficiency of the system.

SUMMARY

The present disclosure seeks to solve at least one of the problems that exist in the related art to at least some extent. One embodiment of the present disclosure is to provide a method for adjusting an oil volume of a compressor of a multi-split system. With such a method, the oil volume functioning in the system can be adjusted by controlling a switch unit and an oil volume adjusting unit when it is detected that the oil volume of the compressor is insufficient, thus improving an operating efficiency of the system.

One embodiment of the present disclosure is to provide a non-transitory computer-readable storage medium.

One embodiment of the present disclosure is to provide an apparatus for adjusting an oil volume of a compressor of a multi-split system.

One embodiment of the present disclosure is to provide a multi-split system.

One embodiment of the present disclosure provides a method for adjusting an oil volume of a compressor of a multi-split system, the multi-split system includes an outdoor unit and a plurality of indoor units, the outdoor unit includes a compressor, an oil separator, an outdoor heat exchanger, an outdoor throttle valve, and an oil volume adjusting device, the oil volume adjusting device and the oil separator are connected in parallel, a first end of the oil volume adjusting device is connected to an gas outlet of the compressor, a second end of the oil volume adjusting device is connected to the outdoor heat exchanger via a four-way valve, a third end of the oil volume adjusting device is connected to a gas return port of the compressor, the oil volume adjusting device includes a switch unit, an oil storage tank and an oil volume adjusting unit, and the method includes: during an operation of the multi-split system, detecting, every first preset duration, whether an oil volume of the compressor is insufficient; if the oil volume of the compressor is insufficient, controlling the oil volume adjusting unit to turn on for a second preset duration and then to turn off; acquiring an accumulated turn-on duration of the oil volume adjusting unit, and determining whether the accumulated turn-on duration exceeds a preset value; if the accumulated turn-on duration exceeds the preset value and it is detected over a third preset duration that the oil volume of the compressor is not insufficient, controlling the switch unit and the oil volume adjusting unit to enable the oil storage tank to recover oil, where the third preset duration is greater than the first preset duration.

With such a method for adjusting the oil volume of the compressor of the multi-split system provided in embodiments of the present disclosure, during the operation of the multi-split system, it is detected, every first preset duration, whether the oil volume of the compressor is insufficient. If the oil volume of the compressor is insufficient, it is controlled to turn on the oil volume adjusting unit for the second preset duration and then to turn off it. The accumulated turn-on duration of the oil volume adjusting unit is acquired, and it is determined whether the accumulated turn-on duration exceeds the preset value. If the accumulated turn-on duration exceeds the preset value and it is detected over the third preset duration that the oil volume of the compressor is not insufficient, the switch unit and the oil volume adjusting unit are controlled to enable the oil storage tank to recover oil. Therefore, with such a method, the oil volume functioning in the system can be adjusted by controlling the switch unit and the oil volume adjusting unit when it is detected that the oil volume of the compressor is insufficient, thus improving the operating efficiency of the system.

In addition, the method for adjusting the oil volume of the compressor of the multi-split system provided in the above embodiments may further include following additional features.

In an embodiment of the present disclosure, when the switch unit is in a turn-on state and the oil volume adjusting unit is in a turn-off state, the oil is recovered to the oil storage tank.

In an embodiment of the present disclosure, during recovering the oil to the oil storage tank, if it is detected that the oil volume of the compressor is insufficient or a duration in which the oil is recovered to the oil storage tank reaches a fourth preset duration, the switch unit is controlled to be turned off and the oil volume adjusting unit is maintained in the turn-off state.

In an embodiment of the present disclosure, a first end of the oil separator is connected to the gas outlet of the compressor, a second end of the oil separator is connected to the second end of the oil volume adjusting device, and a third end of the oil separator is connected to the gas return port of the compressor via a first capillary tube and a first electromagnetic valve, respectively, the oil volume adjusting unit includes a second capillary tube and a second electromagnetic valve in series, and the second capillary tube and the second electromagnetic valve in series are disposed between the gas return port of the compressor and the adjustment port of the oil storage tank, the switch unit includes a third electromagnetic valve disposed between the gas outlet of the compressor and an inlet of the oil storage tank, and a refrigerant outlet of the oil storage tank is connected to the outdoor heat exchanger via the four-way valve.

One embodiment of the present disclosure provides a non-transitory computer-readable storage medium having stored therein computer programs that, when executed by a processor, cause the processor to perform a method for adjusting an oil volume of a compressor of a multi-split system as described above.

With such a non-transitory computer-readable storage medium provided in the embodiments of the present disclosure, when executed by the processor, the processor can perform the method for adjusting the oil volume of the compressor of the multi-split system as described above. Therefore, the oil volume functioning in the system can be adjusted by controlling the switch unit and the oil volume adjusting unit when it is detected that the oil volume of the compressor is insufficient, thus improving the operating efficiency of the system.

One embodiment of the present disclosure provides an apparatus for adjusting an oil volume of a compressor of a multi-split system. The multi-split system includes an outdoor unit and a plurality of indoor units, the outdoor unit includes a compressor, an oil separator, an outdoor heat exchanger, an outdoor throttle valve, and an oil volume adjusting device, the oil volume adjusting device and the oil separator are connected in parallel, a first end of the oil volume adjusting device is connected to an gas outlet of the compressor, a second end of the oil volume adjusting device is connected to the outdoor heat exchanger via a four-way valve, a third end of the oil volume adjusting device is connected to a gas return port of the compressor, the oil volume adjusting device includes a switch unit, an oil storage tank and an oil volume adjusting unit, and the apparatus includes: an oil volume detecting device configured to, during an operation of the multi-split system, detect, every first preset duration, whether an oil volume of the compressor is insufficient; a controlling device configured to, when the oil volume of the compressor is insufficient, control the oil volume adjusting unit to turn on for a second preset duration and then to turn off; an acquiring device configured to acquire an accumulated turn-on duration of the oil volume adjusting unit; a determining device configured to determine whether the accumulated turn-on duration exceeds a preset value; in which the controlling device is further configured to control the switch unit and the oil volume adjusting unit to enable the oil storage tank to recover oil when the accumulated turn-on duration exceeds the preset value and it is detected over a third preset duration that the oil volume of the compressor is not insufficient, where the third preset duration is greater than the first preset duration.

With such an apparatus for adjusting the oil volume of the compressor of the multi-split system provided in embodiments of the present disclosure, during the operation of the multi-split system, the oil volume detecting device detects, every first preset duration, whether the oil volume of the compressor is insufficient. If the oil volume of the compressor is insufficient, the controlling device controls the oil volume adjusting unit to turn on for the second preset duration and then to turn off. The acquiring device acquires the accumulated turn-on duration of the oil volume adjusting unit, and the determining device determines whether the accumulated turn-on duration exceeds the preset value. If the accumulated turn-on duration exceeds the preset value and it is detected over the third preset duration that the oil volume of the compressor is not insufficient, the controlling device controls the switch unit and the oil volume adjusting unit to enable the oil storage tank to recover oil. Therefore, with such an apparatus, the oil volume functioning in the system can be adjusted by controlling the switch unit and the oil volume adjusting unit when it is detected that the oil volume of the compressor is insufficient, thus improving the operating efficiency of the system.

In addition, the apparatus for adjusting the oil volume of the compressor of the multi-split system provided in the above embodiments may further include following additional features.

In an embodiment of the present disclosure, when the switch unit is in a turn-on state and the oil volume adjusting unit is in a turn-off state, the oil is recovered to the oil storage tank.

In an embodiment of the present disclosure, the controlling device is further configured to, during recovering the oil to the oil storage tank, if it is detected that the oil volume of the compressor is insufficient or a duration in which the oil is recovered to the oil storage tank reaches a fourth preset duration, control the switch unit to be turned off and maintain the oil volume adjusting unit in the turn-off state.

In an embodiment of the present disclosure, a first end of the oil separator is connected to the gas outlet of the compressor, a second end of the oil separator is connected to the second end of the oil volume adjusting device, and a third end of the oil separator is connected to the gas return port of the compressor via a first capillary tube and a first electromagnetic valve, respectively, the oil volume adjusting unit includes a second capillary tube and a second electromagnetic valve in series, and the second capillary tube and the second electromagnetic valve in series are disposed between the gas return port of the compressor and the adjustment port of the oil storage tank, the switch unit includes a third electromagnetic valve disposed between the gas outlet of the compressor and an inlet of the oil storage tank, and a refrigerant outlet of the oil storage tank is connected to the outdoor heat exchanger via the four-way valve.

One embodiment of the present disclosure provides a multi-split system, including an apparatus for adjusting an oil volume of a compressor of a multi-split system as described above.

In the multi-split system provided in the embodiments of the present disclosure, the apparatus for adjusting the oil volume of the compressor of the multi-split system as described above is included, and the oil volume functioning in the system can be adjusted by controlling the switch unit and the oil volume adjusting unit when it is detected that the oil volume of the compressor is insufficient, thus improving the operating efficiency of the system.

Figure 1:
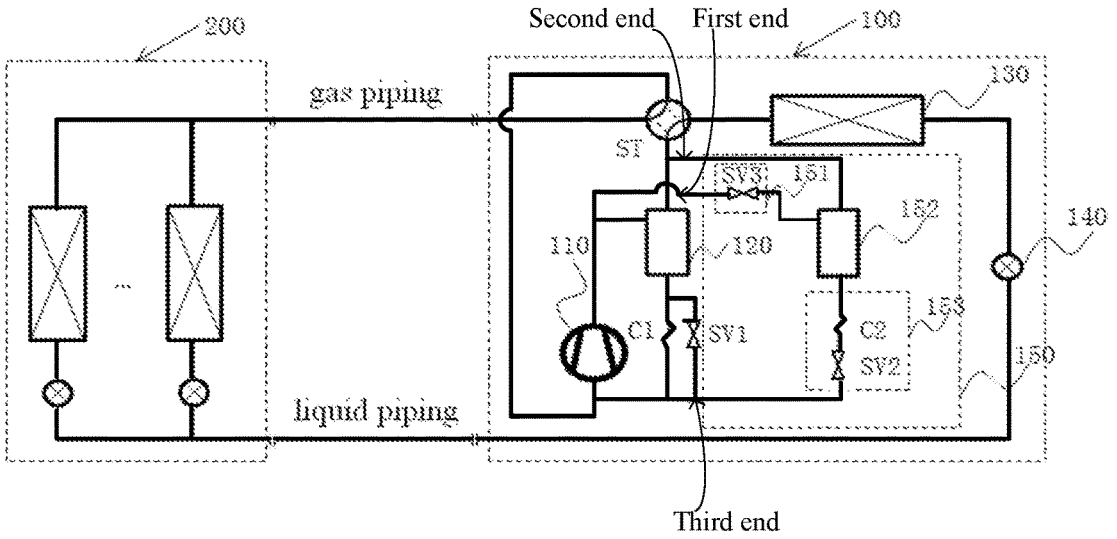
FIG. 1 is a schematic diagram of a multi-split system according to an embodiment of the present disclosure.

REFERENCE NUMERALS outdoor unit 100, a plurality of indoor units 200, compressor 110, oil separator 120, outdoor heat exchanger 130, outdoor throttle valve 140, oil volume adjusting device 150, switch unit 151, oil storage tank 152, oil volume adjusting unit 153, first capillary tube C1, first electromagnetic valve SV1, second capillary tube C2, second electromagnetic valve SV2, third electromagnetic valve SV3, and four-way valve ST.

DETAILED DESCRIPTION

Embodiments of the present disclosure are described in detail below, examples of which are illustrated in the drawings. The same or similar elements are denoted by same reference numerals in different drawings unless indicated otherwise. The embodiments described herein with reference to drawings are explanatory, and used to generally understand the present disclosure. The embodiments shall not be construed to limit the present disclosure.

Method and apparatus for adjusting an oil volume of a compressor of a multi-split system, and a multi-split system having such an apparatus according to embodiments of the present disclosure are described below with reference to the drawings.

Figure 2:
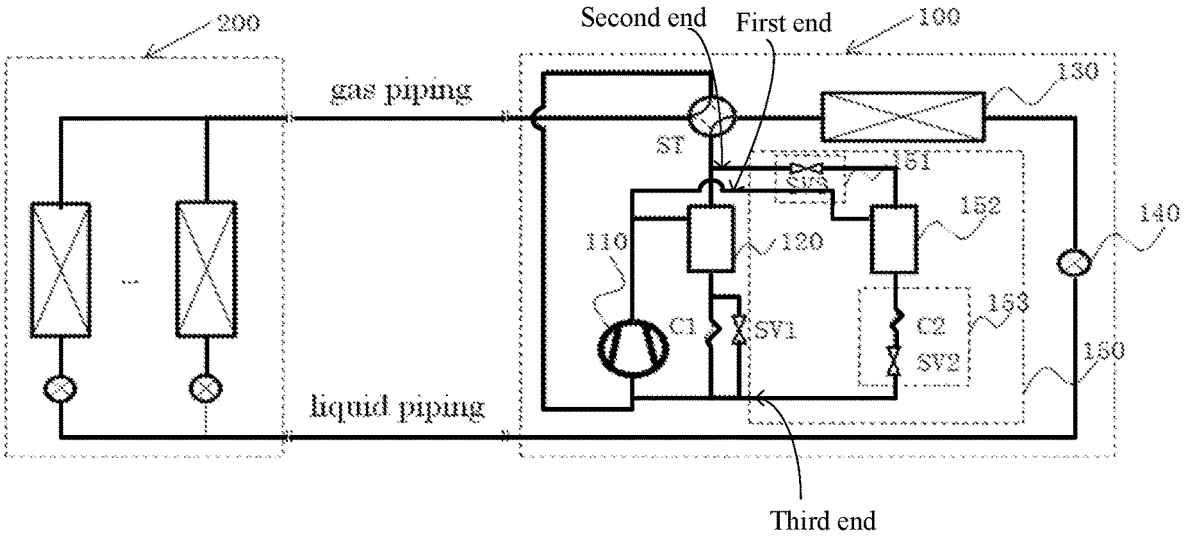
FIG. 2 is a schematic diagram of a multi-split system according to another embodiment of the present disclosure.

In embodiments of the present disclosure, as shown in FIG. 1 and FIG. 2, the multi-split system may include an outdoor unit 100 and a plurality of indoor units 200. The outdoor unit 100 includes a compressor 110, an oil separator 120, an outdoor heat exchanger 130, an outdoor throttle valve 140, and an oil volume adjusting device 150. The oil volume adjusting device 150 and the oil separator 120 are connected in parallel. A first end of the oil volume adjusting device 150 is connected to an gas outlet of the compressor 110, a second end of the oil volume adjusting device 150 is connected to the outdoor heat exchanger 130 via a four-way valve ST, a third end of the oil volume adjusting device 150 is connected to a gas return port of the compressor 110. The oil volume adjusting device 150 includes a switch unit 151, an oil storage tank 152 and an oil volume adjusting unit 153. In one embodiment, the oil volume adjusting device 150 further includes an oil volume detecting unit (not specifically shown in the drawings). The oil volume detecting unit may be an oil viscometer, which is used to detect oil temperature, oil level, etc., to determine whether the compressor is short of oil.

Further, in an embodiment of the present disclosure, as shown in FIG. 1, a first end of the oil separator 120 is connected to the gas outlet of the compressor 110, a second end of the oil separator 120 is connected to the second end of the oil volume adjusting device 150, and a third end of the oil separator 120 is connected to the gas return port of the compressor 110 via a first capillary tube C1 and a first electromagnetic valve SV1, respectively. The oil volume adjusting unit 153 may include a second capillary tube C2 and a second electromagnetic valve SV2 in series, and the second capillary tube C2 and the second electromagnetic valve SV2 in series are disposed between the gas return port of the compressor 110 and the adjustment port of the oil storage tank 152. The switch unit 151 includes a third electromagnetic valve SV3 disposed between the gas outlet of the compressor 110 and an inlet of the oil storage tank 152, and a refrigerant outlet of the oil storage tank 152 is connected to the outdoor heat exchanger 130 via the four-way valve ST.

In one embodiment, as shown in FIG. 1, the oil volume adjusting device 150 and the oil separator 120 are connected in parallel. The first end of the oil volume adjusting device 150 is connected to the gas outlet of the compressor 110, the second end of the oil volume adjusting device 150 is connected to an inlet of the four-way valve ST, the third end of the oil volume adjusting device 150 is connected to the gas return port of the compressor 110 via the capillary tube. The oil volume adjusting device 150 includes the oil storage tank 152, the switch unit 151, the oil volume detecting unit (not specifically shown in the drawings) and the oil volume adjusting unit 153. In one embodiment, the oil storage tank 152 can perform oil separation on exhaust from the compressor 110, and the switch unit 151 may be provided at an inlet (as shown in FIG. 1) or an outlet (as shown in FIG. 2) of the oil storage tank 152 to control the refrigerant to pass through the oil storage tank 152 or not. The oil volume adjusting unit 153 is provided at a pipe connecting the oil storage tank 152 with a low-pressure pipe of the system, and is configured to adjust the oil volume in the oil storage tank 152. The oil volume adjusting unit 153 may be constituted by an electromagnetic valve, by an electromagnetic valve and a capillary tube in series, or by an electronic expansion valve.

It should be noted that the oil storage tank 152 may be one or more, and the oil volume adjusting unit 153 may be constituted by the electromagnetic valve, by the electromagnetic valve and the capillary tube in series, or by the electronic expansion valve. The switch unit 151 may be provided at the inlet or the outlet of the oil storage tank 152. The schematic diagram shown in FIG. 1 or FIG. 2 is only one embodiment of the present disclosure.

Figure 3:
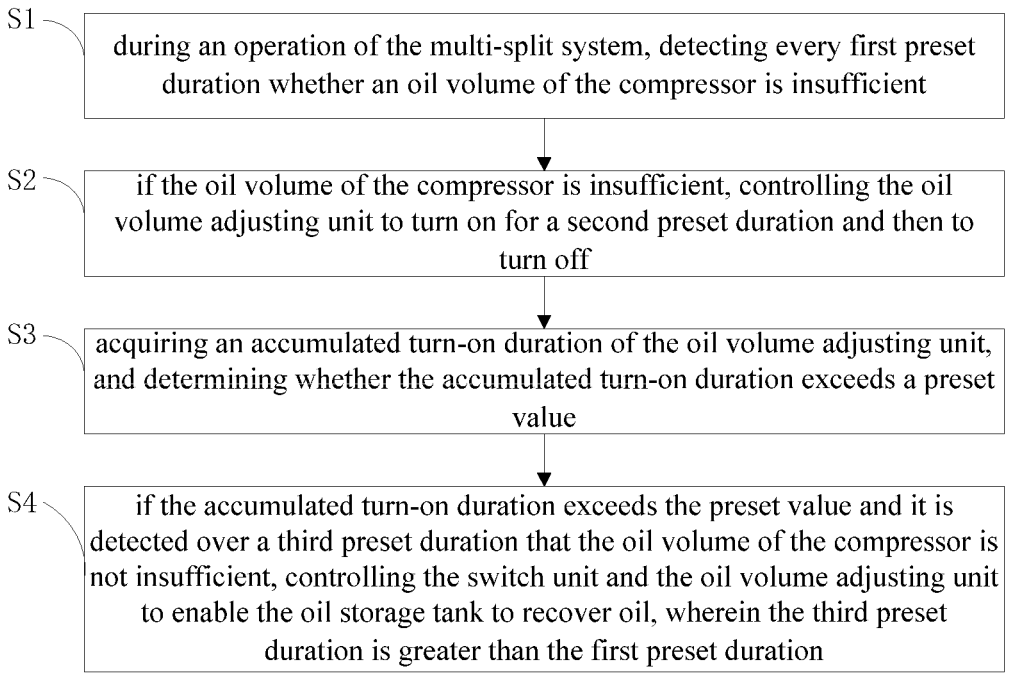
FIG. 3 is a flow chart of a method for adjusting an oil volume of a compressor of a multi-split system according to an embodiment of the present disclosure.

FIG. 3 is a flow chart of a method for adjusting an oil volume of a compressor of a multi-split system according to an embodiment of the present disclosure.

As shown in FIG. 3, the method for adjusting the oil volume of the compressor of the multi-split system according to an embodiment of the present disclosure may include following steps.

In S1, during an operation of the multi-split system, it is detected, every first preset duration, whether an oil volume of the compressor is insufficient. In one embodiment, the first preset duration may be tailored according to different actual situations. The oil viscometer may be used to detect the oil temperature, the oil level and other parameters to determine whether the oil volume of the compressor is insufficient.

In S2, if the oil volume of the compressor is insufficient, the oil volume adjusting unit is controlled to be turned on for a second preset duration and then to be turned off. In one embodiment, the second preset duration may be tailored according to different actual situations.

In S3, an accumulated turn-on duration of the oil volume adjusting unit is acquired, and it is determined whether the accumulated turn-on duration exceeds a preset value. In one embodiment, the preset value may be tailored according to different actual situations.

In S4, if the accumulated turn-on duration exceeds the preset value and it is detected over a third preset duration that the oil volume of the compressor is not insufficient, the switch unit and the oil volume adjusting unit are controlled to enable the oil storage tank to recover oil. In one embodiment, the third preset duration is greater than the first preset duration, and may be tailored according to different actual situations.

In an embodiment of the present disclosure, when the switch unit is in a turn-on state and the oil volume adjusting unit is in a turn-off state, the oil is recovered to the oil storage tank.

In one embodiment, when the multi-split system is operating normally, the switch unit at the inlet or the outlet of the oil storage tank is in a turn-off state, and the oil volume adjusting unit is also in the turn-off state. During the operation of the multi-split system, the oil volume detecting unit detects the oil volume of the compressor every first preset duration t1. When the oil volume of the compressor is detected to be insufficient, the oil volume adjusting unit is turned on for the second preset duration t2. After this, the oil volume adjusting unit is turned off. Meanwhile, a turn-on duration of the oil volume adjusting unit is accumulated, and the accumulated turn-on duration A of the oil volume adjusting unit meets A=A+t2. When the accumulated turn-on duration of the oil volume adjusting unit exceeds the preset value B and it is detected over the third preset duration t3 that the oil volume of the compressor is not insufficient, the switch unit is controlled to be in the turn-on state and the oil volume adjusting unit is controlled to be in the turn-off state, and the oil is recovered to the oil storage tank. In this way, insufficient oil volume and insufficient lubrication in the compressor can be prevented, and problems of power increase of the compressor and abrasion of moving components of the compressor which may cause the compressor to burn can be avoided. Moreover, when it is detected that the oil volume of the compressor is not insufficient, oil recovery is performed to store the reductant oil volume in the oil storage tank.

Further, in an embodiment of the present disclosure, during recovering the oil to the oil storage tank, if it is detected that the oil volume of the compressor is insufficient or a duration in which the oil is recovered to the oil storage tank reaches a fourth preset duration, the switch unit is controlled to be turned off and the oil volume adjusting unit is maintained in the turn-off state.

In other words, during oil recovery of the oil storage tank, if the oil volume of the compressor is insufficient or the duration reaches the fourth preset time t4, the multi-split system retreats from oil recovery operation, and determines whether excess oil volume of the compressor is recovered. At this time, the switch unit is turned off, and the oil volume adjusting unit is in the turn-off state, and the oil recovery is stopped, and the accumulated turn-on duration of the oil volume adjusting unit is reset to zero. If it is detected that the oil volume of the compressor is insufficient during the oil recovery process, the multi-split system immediately retreats from the oil recovery operation and enters the above-mentioned oil volume adjustment process, that is, to control the oil volume adjusting unit to be turned on for the duration t2 and then control the volume adjusting unit to be turned off, and accumulate the turn-on duration of the oil volume adjusting unit.

As described above, by adding an oil volume adjusting device to the multi-split system, the oil volume functioning in the system can be controlled according to the installation characteristics of the system, to improve the operating efficiency of the system.

Figure 4:
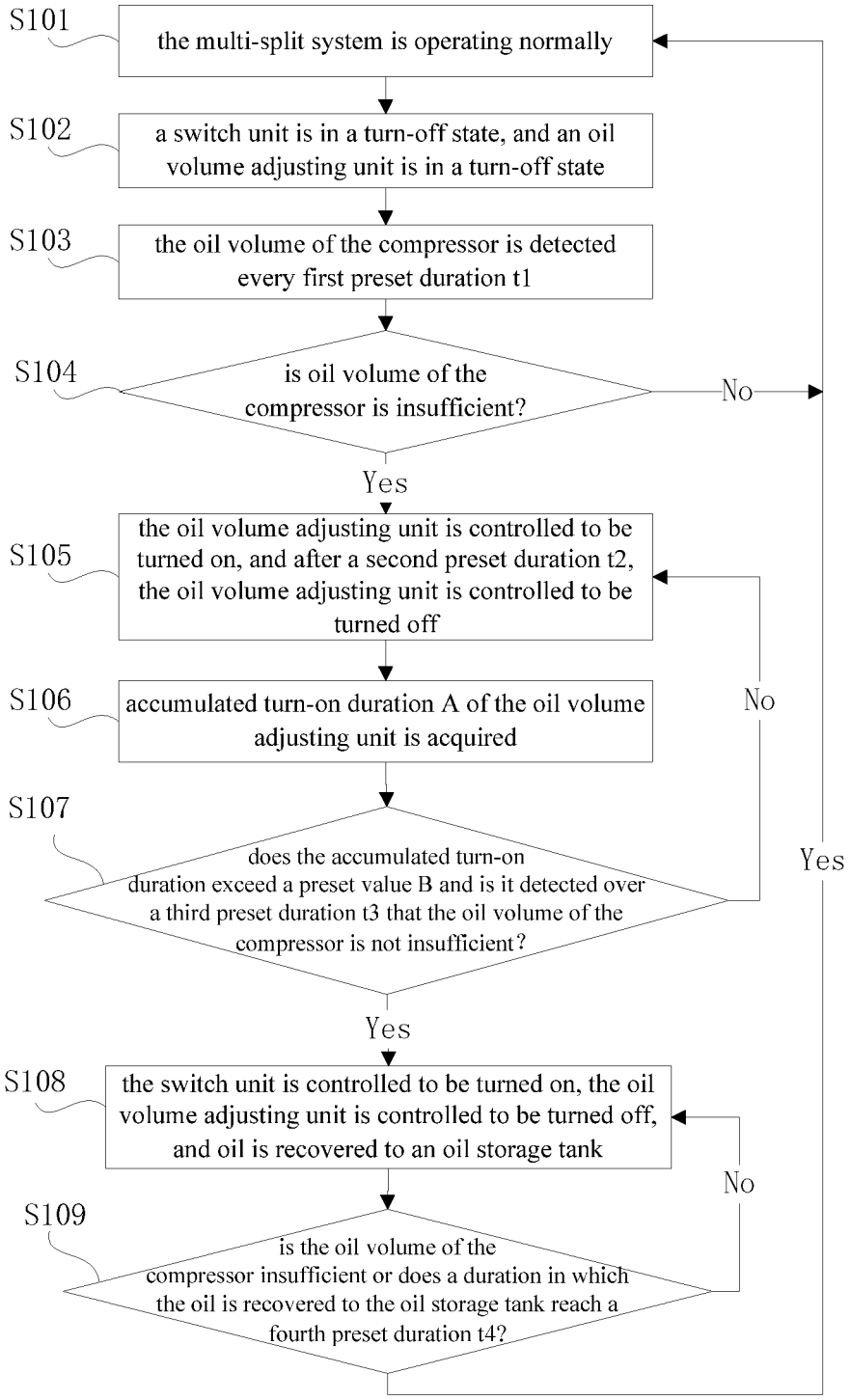
FIG. 4 is a flow chart of a method for adjusting an oil volume of a compressor of a multi-split system according to another embodiment of the present disclosure.

For better understanding of the present disclosure, FIG. 4 is a flow chart of a method for adjusting an oil volume of a compressor of a multi-split system according to another embodiment of the present disclosure. As shown in FIG. 4, the method for adjusting the oil volume of the compressor of the multi-split system may include the following steps.

In S101, the multi-split system is operating normally.

In S102, a switch unit is in a turn-off state, and an oil volume adjusting unit is in a turn-off state.

In S103, the oil volume of the compressor is detected every first preset duration t1.

In S104, it is determined whether the oil volume of the compressor is insufficient. If yes, S105 is performed; if no, it is back to S103.

In S105, the oil volume adjusting unit is controlled to be turned on, and after a second preset duration t2, the oil volume adjusting unit is controlled to be turned off.

In S106, accumulated turn-on duration A of the oil volume adjusting unit is acquired.

In S107, it is determined whether the accumulated turn-on duration exceeds a preset value B, and it is detected over a third preset duration t3 that the oil volume of the compressor is not insufficient. If yes, S108 is performed; if no, it is back to S105.

In S108, the switch unit is controlled to be turned on, the oil volume adjusting unit is controlled to be turned off, and oil is recovered to an oil storage tank.

In S109, it is determined whether the oil volume of the compressor is insufficient or a duration in which the oil is recovered to the oil storage tank reaches a fourth preset duration t4. If yes, it is back to S101; if no, it is back to S108.

In conclusion, according to the method for adjusting the oil volume of the compressor of the multi-split system provided in embodiments of the present disclosure, during the operation of the multi-split system, it is detected, every first preset duration, whether the oil volume of the compressor is insufficient. If the oil volume of the compressor is insufficient, it is controlled to turn on the oil volume adjusting unit for the second preset duration and then to turn off it. The accumulated turn-on duration of the oil volume adjusting unit is acquired, and it is determined whether the accumulated turn-on duration exceeds the preset value. If the accumulated turn-on duration exceeds the preset value and it is detected over the third preset duration that the oil volume of the compressor is not insufficient, the switch unit and the oil volume adjusting unit are controlled to enable the oil storage tank to recover oil. Therefore, with such a method, the oil volume functioning in the system can be adjusted by controlling the switch unit and the oil volume adjusting unit when it is detected that the oil volume of the compressor is insufficient, thus improving the operating efficiency of the system.

Figure 5:
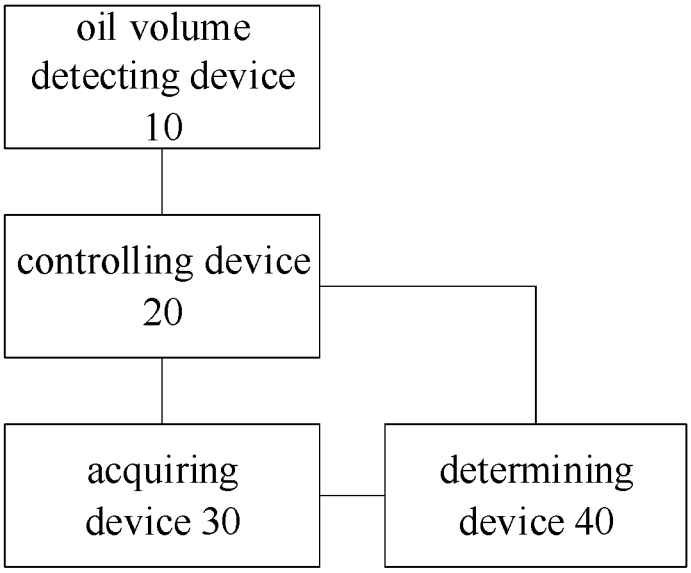
FIG. 5 is a block diagram of an apparatus for adjusting an oil volume of a compressor of a multi-split system according to an embodiment of the present disclosure.

FIG. 5 is a block diagram of an apparatus for adjusting an oil volume of a compressor of a multi-split system according to an embodiment of the present disclosure.

In embodiments of the present disclosure, as shown in FIG. 1 and FIG. 2, the multi-split system may include an outdoor unit 100 and a plurality of indoor units 200. The outdoor unit 100 includes a compressor 110, an oil separator 120, an outdoor heat exchanger 130, an outdoor throttle valve 140, and an oil volume adjusting device 150. The oil volume adjusting device 150 and the oil separator 120 are connected in parallel. A first end of the oil volume adjusting device 150 is connected to an gas outlet of the compressor 110, a second end of the oil volume adjusting device 150 is connected to the outdoor heat exchanger 130 via a four-way valve ST, a third end of the oil volume adjusting device 150 is connected to a gas return port of the compressor 110. The oil volume adjusting device 150 includes a switch unit 151, an oil storage tank 152 and an oil volume adjusting unit 153.

As shown in FIG. 5, the apparatus for adjusting the oil volume of the compressor of the multi-split system may include an oil volume detecting device 10, a controlling device 20, an acquiring device 30 and a determining device 40. The oil volume detecting device 10 is configured to, during an operation of the multi-split system, detect, every first preset duration, whether an oil volume of the compressor 110 is insufficient. The controlling device 20 is configured to, when the oil volume of the compressor 110 is insufficient, control the oil volume adjusting unit 153 to turn on for a second preset duration and then to turn off. The acquiring device 30 is configured to acquire an accumulated turn-on duration of the oil volume adjusting unit 153. The determining device 40 is configured to determine whether the accumulated turn-on duration exceeds a preset value. The controlling device 20 is further configured to control the switch unit 151 and the oil volume adjusting unit 153 to enable the oil storage tank 152 to recover oil when the accumulated turn-on duration exceeds the preset value and it is detected over a third preset duration that the oil volume of the compressor 110 is not insufficient, where the third preset duration is greater than the first preset duration.

In an embodiment of the present disclosure, when the switch unit 151 is in a turn-on state and the oil volume adjusting unit 153 is in a turn-off state, the oil is recovered to the oil storage tank 152.

In an embodiment of the present disclosure, the controlling device 20 is further configured to, during recovering the oil to the oil storage tank 152, if it is detected that the oil volume of the compressor 110 is insufficient or a duration in which the oil is recovered to the oil storage tank 152 reaches a fourth preset duration, control the switch unit 151 to be turned off and maintain the oil volume adjusting unit 153 in the turn-off state.

In an embodiment of the present disclosure, as shown in FIG. 1, a first end of the oil separator 120 is connected to the gas outlet of the compressor 110, a second end of the oil separator 120 is connected to the second end of the oil volume adjusting device 150, and a third end of the oil separator 120 is connected to the gas return port of the compressor 110 via a first capillary tube C1 and a first electromagnetic valve SV1, respectively. The oil volume adjusting unit 153 may include a second capillary tube C2 and a second electromagnetic valve SV2 in series, and the second capillary tube C2 and the second electromagnetic valve SV2 in series are disposed between the gas return port of the compressor 110 and the adjustment port of the oil storage tank 152. The switch unit 151 includes a third electromagnetic valve SV3 disposed between the gas outlet of the compressor 110 and an inlet of the oil storage tank 152, and a refrigerant outlet of the oil storage tank 152 is connected to the outdoor heat exchanger 130 via the four-way valve ST.

It should be noted that details disclosed in the embodiments of the present method for adjusting the oil volume of the compressor of the multi-split system are also applicable to the apparatus for adjusting the oil volume of the compressor of the multi-split system of the present disclosure, which will not be elaborated in detail herein.

With such an apparatus for adjusting the oil volume of the compressor of the multi-split system provided in embodiments of the present disclosure, during the operation of the multi-split system, the oil volume detecting device detects, every first preset duration, whether the oil volume of the compressor is insufficient. If the oil volume of the compressor is insufficient, the controlling device controls the oil volume adjusting unit to turn on for the second preset duration and then to turn off. The acquiring device acquires the accumulated turn-on duration of the oil volume adjusting unit, and the determining device determines whether the accumulated turn-on duration exceeds the preset value. If the accumulated turn-on duration exceeds the preset value and it is detected over the third preset duration that the oil volume of the compressor is not insufficient, the controlling device controls the switch unit and the oil volume adjusting unit to enable the oil storage tank to recover oil. Therefore, with such an apparatus, the oil volume functioning in the system can be adjusted by controlling the switch unit and the oil volume adjusting unit when it is detected that the oil volume of the compressor is insufficient, thus improving the operating efficiency of the system.

In addition, the present disclosure provides in embodiments a non-transitory computer-readable storage medium having stored therein computer programs that, when executed by a processor, cause the processor to perform a method for adjusting an oil volume of a compressor of a multi-split system as described above.

With such a non-transitory computer-readable storage medium provided in the embodiments of the present disclosure, by performing the method for adjusting the oil volume of the compressor of the multi-split system as described above, the oil volume functioning in the system can be adjusted by controlling the switch unit and the oil volume adjusting unit when it is detected that the oil volume of the compressor is insufficient, thus improving the operating efficiency of the system.

In addition, the present disclosure provides in embodiments a multi-split system, including an apparatus for adjusting an oil volume of a compressor of a multi-split system as described above.

In the multi-split system provided in the embodiments of the present disclosure, the apparatus for adjusting the oil volume of the compressor of the multi-split system as described above is included, and the oil volume functioning in the system can be adjusted by controlling the switch unit and the oil volume adjusting unit when it is detected that the oil volume of the compressor is insufficient, thus improving the operating efficiency of the system.

Reference throughout this specification to "an embodiment", "some embodiments", "an example", "a specific example", or "some examples" means that a particular feature, structure, material, or characteristic described in connection with the embodiment or example is included in at least one embodiment or example of the present disclosure. Thus, the appearances of above phrases in various places throughout this specification are not necessarily referring to the same embodiment or example of the present disclosure. Furthermore, the particular features, structures, materials, or characteristics may be combined in any suitable manner in one or more embodiments or examples. In addition, different embodiments or examples described in the specification, as well as features of embodiments or examples, without conflicting.

Thus, the feature defined with "first" and "second" may include one or more of this feature. In the description of the present disclosure, unless specified otherwise, "a plurality of" means two or more than two, for example two or three.

It will be understood that, the flow chart or any process or method described herein in other manners may represent a device, segment, or portion of code that includes one or more executable instructions to implement the specified logic function(s) or that includes one or more executable instructions of the steps of the progress, and the scope of an embodiment of the present disclosure includes other implementations. Although the flow chart shows a specific order of execution, it is understood that the order of execution may differ from that which is depicted. For example, the order of execution of two or more boxes may be scrambled relative to the order shown.

The logic and/or step described in other manners herein or shown in the flow chart, for example, a particular sequence table of executable instructions for realizing the logical function, may be specifically implemented in any computer readable medium to be used by the instruction execution system, device or equipment (such as the system based on computers, the system including processors or other systems configured to obtain the instruction from the instruction execution system, device and equipment and executing the instruction), or to be used in combination with the instruction execution system, device and equipment. As to the specification, "the computer readable medium" may be any device adaptive for including, storing, communicating, propagating or transferring programs to be used by or in combination with the instruction execution system, device or equipment. More specific examples of the computer readable medium include but are not limited to: an electronic connection (an electronic device) with one or more wires, a portable computer enclosure (a magnetic device), a random access memory (RAM), a read only memory (ROM), an erasable programmable read-only memory (EPROM or a flash memory), an optical fiber device and a portable compact disk read-only memory (CDROM). In addition, the computer readable medium may even be a paper or other appropriate medium configured to print programs thereon, this is because, for example, the paper or other appropriate medium may be optically scanned and then edited, decrypted or processed with other appropriate methods when necessary to obtain the programs in an electric manner, and then the programs may be stored in the computer memories.

It should be understood that each part of the present disclosure may be realized by the hardware, software, firmware or their combination. In the above embodiments, a plurality of steps or methods may be realized by the software or firmware stored in the memory and executed by the appropriate instruction execution system. For example, if it is realized by the hardware, likewise in another embodiment, the steps or methods may be realized by one or a combination of the following techniques known in the art: a discrete logic circuit having a logic gate circuit for realizing a logic function of a data signal, an application-specific integrated circuit having an appropriate combination logic gate circuit, a programmable gate array (PGA), a field programmable gate array (FPGA), etc.

The programs may be stored in a computer readable storage medium, and the programs include one or a combination of the steps in the method embodiments of the present disclosure when run on a computer.

In addition, each function cell of the embodiments of the present disclosure may be integrated in a processing device, or these cells may be separate physical existence, or two or more cells are integrated in a processing device. The integrated device may be realized in a form of hardware or in a form of software function devices. When the integrated device is realized in a form of software function device and is sold or used as a standalone product, the integrated device may be stored in a computer readable storage medium.

The storage medium mentioned above may be read-only memories, magnetic disks, CD, etc. Although explanatory embodiments have been shown and described.

In the specification, it is to be understood that terms such as "central", "longitudinal", "lateral", "length", "width", "thickness", "upper", "lower", "front", "rear", "left", "right", "vertical", "horizontal", "top", "bottom", "inner", "outer", "clockwise", "counterclockwise", "axial", "radial" and "circumferential" should be construed to refer to the orientation as then described or as shown in the drawings under discussion. These relative terms are for convenience of description and do not require that the present disclosure be constructed or operated in a particular orientation, and thus shall not be construed to limit the present disclosure.

In the present disclosure, unless specified or limited otherwise, the terms "mounted", "connected", "coupled", "fixed" and the like are used broadly, and may be, for example, fixed connections, detachable connections, or integral connections; may also be mechanical or electrical connections; may also be direct connections or indirect connections via intervening structures; may also be inner communications of two elements.

In the description, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed there between. Furthermore, a first feature "on", "above" or "on top of" a second feature may include an embodiment in which the first feature is right or obliquely "on", "above" or "on top of" the second feature, or just means that the first feature is at a height higher than that of the second feature; while a first feature "below", "under" or "on bottom of" a second feature may include an embodiment in which the first feature is right or obliquely "below", "under" or "on bottom of" the second feature, or just means that the first feature is at a height lower than that of the second feature.

What is claimed is:

1. A method for adjusting an oil volume of a compressor of a multi-split system, wherein the multi-split system comprises an outdoor unit and a plurality of indoor units;

wherein the outdoor unit comprises a compressor, an oil separator, an outdoor heat exchanger, an outdoor throttle valve, and an oil volume adjusting device, the oil volume adjusting device and the oil separator are connected in parallel, a first end of the oil volume adjusting device is connected to a gas outlet of the compressor, a second end of the oil volume adjusting device is connected to the outdoor heat exchanger via a four-way valve, a third end of the oil volume adjusting device is connected to a gas return port of the compressor;

wherein the oil volume adjusting device comprises a switch unit, an oil storage tank and an oil volume adjusting unit;

the method comprising:

during an operation of the multi-split system, keeping detection of an oil volume of the compressor and determining whether the oil volume is sufficient after an interval having a first pre-set duration;

in determination that the oil volume is insufficient, performing following steps:

controlling the oil volume adjusting unit to operate for a second pre-set duration;

controlling the oil volume adjusting unit to stop operation after the second pre-set duration;

acquiring an accumulated operation duration of the oil volume adjusting unit, and determining whether the accumulated operation duration exceeds a pre-set value; and in determination that the accumulated operation duration exceeds the pre-set value and the oil volume is sufficient for a third pre-set duration, controlling the switch unit and the oil volume adjusting unit to enable the oil storage tank to recover oil, wherein the third pre-set duration is greater than the first pre-set duration.

2. The method for adjusting the oil volume of the compressor of the multi-split system according to claim 1, wherein when the switch unit is in a turn-on state and the oil volume adjusting unit is in a turn-off state, the oil is recovered to the oil storage tank.

3. The method for adjusting the oil volume of the compressor of the multi-split system according to claim 1, wherein during recovering the oil to the oil storage tank, if it is determined that the oil volume of the compressor is insufficient or a duration in which the oil is recovered to the oil storage tank reaches a fourth pre-set duration, the switch unit is controlled to be turned off and the oil volume adjusting unit is maintained in a turn-off state.

4. The method for adjusting the oil volume of the compressor of the multi-split system according to claim 1, wherein a first end of the oil separator is connected to the gas outlet of the compressor, a second end of the oil separator is connected to the second end of the oil volume adjusting device, and a third end of the oil separator is connected to the gas return port of the compressor via a first capillary tube and a first electromagnetic valve, respectively, the oil volume adjusting unit comprises a second capillary tube and a second electromagnetic valve in series, and the second capillary tube and the second electromagnetic valve in series are disposed between the gas return port of the compressor and an adjustment port of the oil storage tank, the switch unit comprises a third electromagnetic valve disposed between the gas outlet of the compressor and an inlet of the oil storage tank, and a refrigerant outlet of the oil storage tank is connected to the outdoor heat exchanger via the four-way valve.

* * * * *